US007331643B2

(12) United States Patent
Huber et al.

(10) Patent No.: US 7,331,643 B2
(45) Date of Patent: Feb. 19, 2008

(54) PIECE OF FURNITURE WITH A MOVABLE FURNITURE COMPONENT

(75) Inventors: Edgar Huber, Hard (AT); Uwe Scheffknecht, Höchst (AT)

(73) Assignee: Julius Blum GmbH, Hochst (AT)

( * ) Notice: Subject to any disclaimer, the term of this patent is extended or adjusted under 35 U.S.C. 154(b) by 0 days.

(21) Appl. No.: 11/270,590

(22) Filed: Nov. 10, 2005

(65) Prior Publication Data

US 2006/0061245 A1 Mar. 23, 2006

Related U.S. Application Data

(63) Continuation of application No. PCT/AT2004/000149, filed on May 3, 2004.

(30) Foreign Application Priority Data

May 19, 2003 (AT) ..... A 761-2003

(51) Int. Cl.
*A47B 88/00* (2006.01)

(52) U.S. Cl. ..... 312/319.5; 312/319.6

(58) Field of Classification Search .. 312/319.5–319.8, 312/333, 215, 222, 334.2, 319.1–319.3, 334.3, 312/330.1, 331; 70/85–88
See application file for complete search history.

(56) References Cited

U.S. PATENT DOCUMENTS 2,022,382 A * 11/1935 Mosler et al. ..... 109/46
2,730,053 A * 1/1956 Ellithorpe ..... 109/19
2,873,159 A * 2/1959 Becker ..... 312/319.7
3,005,672 A * 10/1961 Becker ..... 312/319.7
3,028,209 A * 4/1962 Hinkel et al. ..... 312/319.7
3,028,210 A * 4/1962 Byars ..... 312/312
3,854,784 A * 12/1974 Hunt et al. ..... 312/9.63
3,862,788 A 1/1975 Hock et al.
4,268,076 A * 5/1981 Itoi ..... 292/216
4,720,154 A 1/1988 Seiter
4,750,160 A * 6/1988 Miller et al. ..... 369/30.86

(Continued)

FOREIGN PATENT DOCUMENTS

DE 29 11 772 10/1979

(Continued)

*Primary Examiner*—Janet M. Wilkens
(74) *Attorney, Agent, or Firm*—Wenderoth, Lind & Ponack, L.L.P.

(57) ABSTRACT

A piece of furniture with a movable furniture component, in particular a drawer or door, includes a drive unit and a device for the mechanical transmission of force from the drive unit to the movable furniture component or the body of the furniture. In particular, a pin is arranged on a lever that can be powered by the drive unit, for the ejection and/or insertion of the movable furniture component. The device for the mechanical transmission of force is arranged in a guide track for the transmission of tensile and thrust forces.

21 Claims, 8 Drawing Sheets

U.S. PATENT DOCUMENTS

| | | | | |
|---|---|---|---|---|
| 5,087,107 | A * | 2/1992 | Fumanelli | 312/333 |
| 5,386,636 | A * | 2/1995 | Asano | 312/319.2 |
| 5,575,515 | A * | 11/1996 | Iwamoto et al. | 292/341.17 |
| 5,625,533 | A * | 4/1997 | Kim et al. | 361/681 |
| 5,804,937 | A | 9/1998 | Sasajima et al. | |
| 6,027,193 | A * | 2/2000 | Domenig et al. | 312/334.14 |
| 6,101,160 | A * | 8/2000 | Busch et al. | 720/647 |
| 6,902,243 | B2 * | 6/2005 | Bober | 312/306 |
| 2002/0171251 | A1 * | 11/2002 | Bieck et al. | 292/336.3 |
| 2004/0100169 | A1 * | 5/2004 | Huber et al. | 312/319.5 |
| 2006/0250059 | A1 * | 11/2006 | Lemm | 312/331 |

FOREIGN PATENT DOCUMENTS

| | | |
|---|---|---|
| DE | 29 24 145 | 12/1980 |
| EP | 0 410 086 A1 | 1/1991 |
| EP | 0 743 032 A2 | 11/1996 |
| EP | 1 353 032 A1 | 10/2003 |

* cited by examiner

PIECE OF FURNITURE WITH A MOVABLE FURNITURE COMPONENT

This is a continuation application of International Application No. PCT/AT2004/000149, filed May 3, 2004.

BACKGROUND OF THE INVENTION

The present invention relates to a piece of furniture with a movable furniture component (in particular, a drawer or door), a drive unit (in particular, electric), and a device for the mechanical transmission of force from the drive unit to the movable furniture component or the body of the piece of furniture. In particular, a pin is arranged on a lever which can be powered by the drive unit, for the ejection and/or insertion of the movable furniture component. The device is arranged in a guide track for the transmission of tensile and thrust forces.

Devices with which the movable furniture component can be ejected via a lever are used, in particular, in a piece of furniture with movable furniture components that, for reasons of design or for practical reasons, have no handles. The manual opening of such a furniture door or drawer is made possible for a user only after the powered opening of the movable furniture component over a first distance to form a gripping gap between the movable furniture component and the body of the furniture. Spring-loaded mechanisms (touch-latch) or drawers driven by an electric motor are known, for example.

For example, a cupboard with several handle-less drawers is disclosed in U.S. Pat. No. 5,158,347, in which the drawer to be opened can be selected by entering a code and can then be partly withdrawn from the cupboard via a pin, attached to the drawer, off which a powered eccentric rolls. The problem here, among other things, is that the opening process is designed differently for drawers filled to different extents.

A drawer with a certain minimum contents weight rests against the eccentric with the pin arranged on it over the entire acceleration distance provided and is thus accelerated by it in the proposed manner. A drawer below this minimum weight will already undergo such a great acceleration after covering part of the overall provided acceleration distance that the pin lifts off from the eccentric and the drawer moves unpowered, under the influence of the frictional forces only. Through the friction-induced dissipation of the kinetic energy, the drawer then reduces its speed until the pin arranged on it again comes into contact with the powered eccentric, as a result of which the drawer is accelerated again. This results overall in an uneven, sputtering acceleration of the drawer. This is not only undesirable for reasons of user acceptance, but also accelerates the wear of the mechanical components of the piece of furniture and the drawer.

In addition, the state of the art described in U.S. Pat. No. 5,158,347 has the disadvantage that, with the device shown there, it is not possible to insert the opened drawer into its closed end-position. In order to perform this function, an additional automatic insertion mechanism would thus have to be provided, which is disadvantageous both for cost reasons and because of the associated additional design outlay and the increased space requirement.

The arrangement of the device for the transmission of force in a guide track is disclosed in U.S. Pat. No. 3,862,788. This has among others the advantage that during the ejection of the movable furniture component, an interruption of the contact between the device for the mechanical transmission of force and the movable furniture component is prevented.

A further advantage is that with such a device, the insertion of the movable furniture component at a distance positioned in front of the closed end-position of the movable furniture component with the device used for ejection is also made possible.

However the problem here is that the length of the lever shown in U.S. Pat. No. 3,862,788 for the mechanical transmission of force must be chosen for each movable furniture component according to the distance between the closed and the open end-positions.

SUMMARY OF THE INVENTION

The object of the invention is to create a device which avoids problems known in the state of the art.

This is achieved according to the invention in that the guide track has at least one position at which the device for the mechanical transmission of force can be inserted into the guide track or removed from it.

In this way the advantages of each of the devices known in the state of the art are retained whilst their disadvantages are avoided.

In principle there are two advantageous possibilities, in design terms, for realizing the apparatus according to the invention. It can either be provided, and is also particularly preferred, to arrange the drive unit and the device for the mechanical transmission of force on the body of the furniture and the guide track on the movable furniture component. On the other hand, it is also possible to arrange the drive unit and the device for the mechanical transmission of force on the movable furniture component and the guide track on the body of the furniture. Compared with the first possibility, this solution variant has the disadvantage that by arranging the drive unit on the furniture component to be moved, the mass to be accelerated and thus the inertia to be overcome is increased.

The drive unit can comprise an electric motor, for example. It can also be provided that the drive unit comprises a control or regulation apparatus. A control or regulation apparatus that is structurally separate from the drive unit can also be provided.

The guide track itself can be formed by any apparatus that allows only an essentially linear movement. The phrase flat guide track means any realization of a track restricted to one plane by at least two boundaries running at approximately a constant distance from each other.

Structurally, the guide track can be in one piece with the movable furniture component or body of the furniture piece, or in the form of a separate component attached to the movable furniture component or body of the furniture piece. The guide track can be formed for example by a groove or recess. In the separate version, the guide track can be manufactured independently of the movable furniture component or body of the furniture piece, so that existing production processes for the movable furniture component or the body of the furniture piece need not be changed.

The drive unit can be triggered by sensors that detect a movement, produced manually by a user, of the movable furniture component. Thus, there is no need for pushbuttons or similar components to be operated by the user.

Optical sensors can be used, for example. Other non-contact sensor types, such as for example capacitive or inductive sensors, would also be conceivable. The arrangement of contact sensors, such as for example pushbutton switches, can however also be provided.

In the case of an advantageous version of the invention, it can be provided that the device for the mechanical transmission of force can be moved between two end-positions. The end-positions can preferably be detected by sensors, preferably optical sensors, the signals of which can be fed at least to the control or regulation unit. The arrangement of the sensors in the vicinity of the end-positions then suggests itself. The ejection or insertion of the movable furniture component in contact with the device for the mechanical transmission of force can be triggered via these sensors in one end-position, and the deactivation of the drive unit take place after the other end-position is reached in each case. The drive unit is thus only active as long as the device for the mechanical transmission of force is located between its two end-positions.

The device for the mechanical transmission of force can be formed for example by a pin that is arranged on a lever that is swivellable—preferably to an extent limited by two end-positions. The pin runs in the guide track to exert tensile and thrust forces. To reduce the frictional forces between the pin and the boundaries of the guide track, a castor can be arranged on the pin.

Preferably, it is provided that the movable furniture component can be moved between a closed and an opened end-position and the device for the mechanical transmission of force can be inserted into the guide track or removed from it between the closed and the open end-position of the movable furniture component. As a result, the support by the drive unit thus occurs only on a partial stretch of the whole distance between the closed and the opened end-position of the movable furniture component.

This can be realized particularly simply in design terms in that the device for the mechanical transmission of force has a pin arranged on a lever able to be powered by the drive unit, and the length of the lever is less than the distance between the closed and the opened end-position of the movable furniture component.

It can be provided for example that the length of the lever is less than half the distance, preferably less than one third of the distance, between the closed and the opened end-position of the movable furniture component.

In the handle-less version of the movable furniture component, the ejection function can, for example, be triggered by the fact that in its closed end-position there is still some room for the manual movement of the movable furniture component against the intended ejection direction. The movement, caused by the manual movement of the movable furniture component, of the device for the mechanical transmission of force in the direction of the sensor arranged in a first end-position of the device is detected by the sensor in a way, depending on the type of sensor, that is familiar to the person skilled in the art, and this detection signal is fed to the drive unit, whereupon the drive unit begins the ejection process. In this version, to trigger the ejection process of the movable furniture component, the user must thus simply exert pressure at any point on the front of the movable furniture component in its closed end-position to cause the activation of the drive unit and consequently the ejection of the movable furniture component. The drive unit is deactivated as soon as the sensor arranged in the second end-position of the device for the mechanical transmission of force is triggered by the device for the mechanical transmission of force.

If the movable furniture component is equipped with handles, the activation of the ejection or insertion function can of course be triggered by pulling or pushing on the handle, which is detected by the sensors in the end-positions of the device for the mechanical transmission of force and reported to the drive unit.

The triggering by exertion of tension or thrust can for example be realized as follows:

The device for the mechanical transmission of force is a pin arranged on a powered lever. In the first end-position of the device for the mechanical transmission of force, there are arranged in the vicinity of the lever two optical sensors that have activation paths of different lengths. The sensors register changes in the illumination state. If the movable furniture component is in its closed end-position, the first sensor is covered by the lever while the second sensor is free.

If tension is exerted on the movable furniture component, the lever releases the first sensor, which is detected by the latter and reported to the control or regulation unit of the drive unit.

The drive unit is then activated. The second sensor is not active during this process.

If pressure is exerted on the movable furniture component, the latter moves somewhat further into the piece of furniture, which is made possible by the room provided for this. The lever is thereby also forced somewhat closer to the two sensors. The first sensor remains covered and thus inactive while the second sensor, which was previously free, is now covered by the lever. It reports this change in the illumination state to the control or regulation unit, which then triggers the drive unit.

The function of the two sensors can of course also be assumed by one double sensor.

In another embodiment triggering can take place as follows:

The device for the mechanical transmission of force is developed as a pin arranged on a powered lever, a cam being arranged at the opposite end of the lever. If the lever is moved (anti-) clockwise, the cam also moves (anti-) clockwise. In the vertical position of the lever the cam covers an optical sensor.

If tension is exerted on the movable furniture component, the cam is swivelled clockwise and thus releases the sensor, which triggers the drive unit.

If pressure is exerted on the movable furniture component, the cam is swivelled anti-clockwise and releases the sensor, which likewise triggers the drive unit. In this case, in order to prevent the triggering of yet another switching process after the triggering of the lever and the anti-clockwise swivelling of the cam caused thereby, the renewed signal of the sensor can for example be ignored for a short period by a timer.

Of course, it can also be provided that the sensors do not recognize the manually caused movement of the movable furniture component indirectly from the movement of the mechanical device for the transmission of force, but detect the movement of the movable furniture component directly.

It would also be possible to trigger the exertion of tension by a sensor that detects the first end-position of the device for the mechanical transmission of force, and the pressure exertion depending on a sensor arranged on the movable furniture component.

After the device for the mechanical transmission of force has left the guide track, the further movement of the movable furniture component takes place under the influence of the frictional forces alone, caused by the housing of the movable furniture component, and also any other manual exertions of force by the user.

Because the device for the mechanical transmission of force has left the guide track after the end of the ejection process, the movable furniture component must of course, in order to activate the insertion function, first be moved by the user towards the closed end-position until the device for the mechanical transmission of force re-enters the guide track. Because the device for the mechanical transmission of force, upon a further manual movement of the movable furniture component by the user, is also moved with it by the guide forces exerted by the boundaries of the guide track, the sensor arranged in the second end-position of the device for the mechanical transmission of force responds and activates the drive unit to trigger the insertion function.

At what distance of the movable furniture component before its closed end-position the insertion function is triggered can be chosen according to the length of the entire distance between the closed and the fully-opened end-position of the movable furniture component. For example, if this distance is approximately 50 cm long, the insertion function can take place over the last 10 cm before the closed end-position of the movable furniture component.

The invention moreover relates to a guide track for guiding a device for the mechanical transmission of force to a movable furniture component, which has at least one position at which the device for the mechanical transmission of force can be inserted into the guide track or removed from it. The guide track preferably has two ends and is open at least one end.

The guide track preferably runs in the area of the non-open (closed) end diagonally to the direction of movement of the movable furniture component. The device for the mechanical transmission of force can thereby, when pressure is exerted on the movable furniture component, be entrained by the sliding block in the direction of the pressure exertion. This can be registered by an appropriately arranged sensor and used to trigger the drive unit.

The guide track is preferably curved, the curve being able to vary. An optimum power transmission is thereby made possible.

In an advantageous version of the invention, it is provided that the tangent of the guide track in the area of the position at which the device for the mechanical transmission of force can be inserted into the guide track or removed from it is parallel to the direction of movement of the movable furniture component. This permits the trouble-free entry and exit of the device for the mechanical transmission of force.

The invention also relates to a method for the ejection and/or insertion of a movable furniture component or body of furniture, in particular a drawer or door, which is housed on or in a piece of furniture. The piece of furniture has a drive unit and a device for the mechanical transmission of force from the drive unit to the movable furniture component or the body of furniture. In particular, a pin is arranged on a lever powered by the drive unit. The device for the mechanical transmission of force exerts tensile and thrust forces on the movable furniture component for the ejection and/or insertion of the movable furniture component along a guide track arranged on the body of the furniture piece or on the movable furniture component. The device for the mechanical transmission of force is moved out of the guide track after a distance traveled by the movable furniture component from its closed end-position.

In a version of the method according to the invention, the movable furniture component can be pushed out of the closed end-position into the fully-opened end-position by the drive unit via the device for the mechanical transmission of force.

In another version of the method according to the invention, it can be provided that the device for the mechanical transmission of force is moved in the same guide track in a first direction during the ejection and in a second direction opposite to the first during the insertion.

In another advantageous version of the invention, the control or regulation of the drive unit takes place depending on the current induced in the drive unit by the movement of the movable furniture component and/or the induced voltage. This represents a simple possibility of exerting influence in a targeted way on the movement of the movable furniture component. The torque exerted on the movable furniture component is preferably established via the current measurement. It can alternatively or additionally be provided that the speed of the movable furniture component be established via the voltage measured. Influence can then be exerted according to the measured speed of the movable furniture component or according to the torque exerted on the movable furniture component.

For example, during the insertion process, the drive unit can counteract the movement of the movable furniture component until a preset or presettable current or voltage—and thus where appropriate a corresponding speed of the movable furniture component—is measured. This can take place in various ways. For example, the drive unit can be fed with current to brake the movable furniture component. Alternatively, the drive unit could also simply be short-circuited to brake the movable furniture component. In both ways, a preset or presettable speed profile can be achieved during the insertion of the movable furniture component.

For example, it can be provided that the movable furniture component is first braked almost to a stop after the device for the mechanical transmission of force is moved into the guide track and then pulled into the fully-closed end-position.

However, it can also be provided for example that the position of the movable furniture component or of the device for the mechanical transmission of force is detected with a position-measurement apparatus and used as a control or regulating variable. When using a position-measurement apparatus, the sensors for monitoring the end-positions of the device for the mechanical transmission of force can of course be omitted. The speed of the movable furniture component can also be ascertained using the position-measurement apparatus. It can be provided for example that the position-measurement apparatus is integrated in the electric motor. Such electric motors are commercially available.

The invention also relates to a movable furniture component, in particular a drawer or door, with either a drive unit and a device for the mechanical transmission of force or a guide track being arranged on the movable furniture component.

It is self-evident that generally, with a movable furniture component arranged at ground level, instead of manual operation, the operation can be carried out by the foot of a user.

BRIEF DESCRIPTION OF THE DRAWINGS

An embodiment of the invention is described below by way of example, using the figures in the attached drawings, in which.

DETAILED DESCRIPTION OF THE INVENTION

Figure 1:
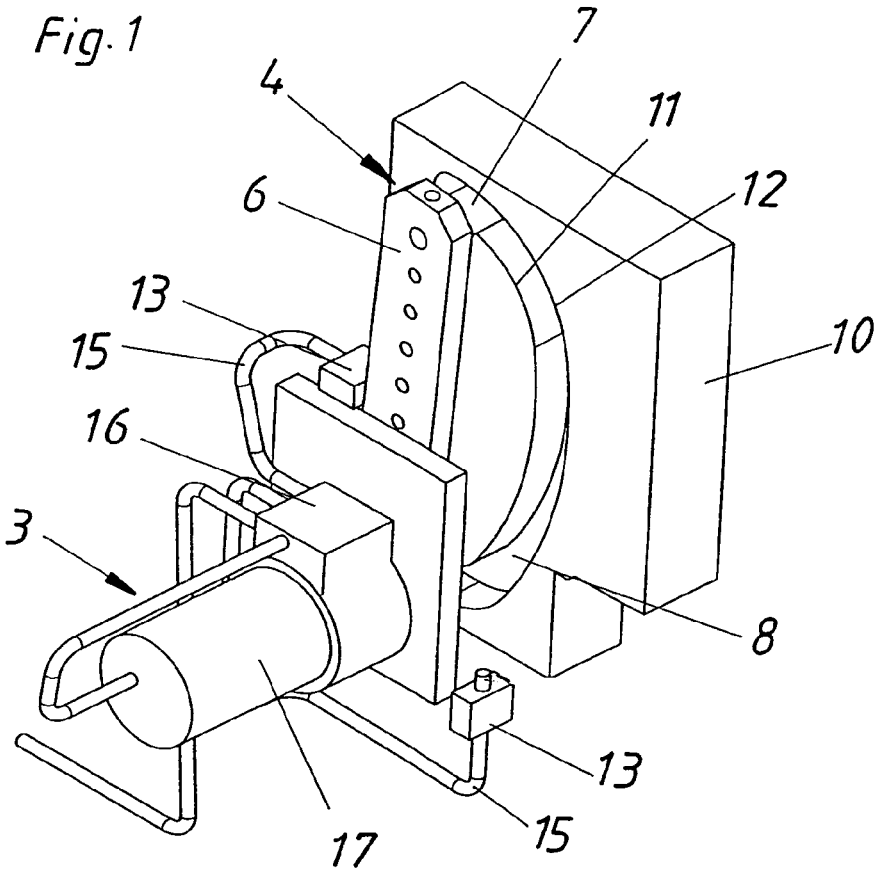
FIG. 1 is a first perspective view of an ejection or insertion device according to the invention.
Figure 10B:
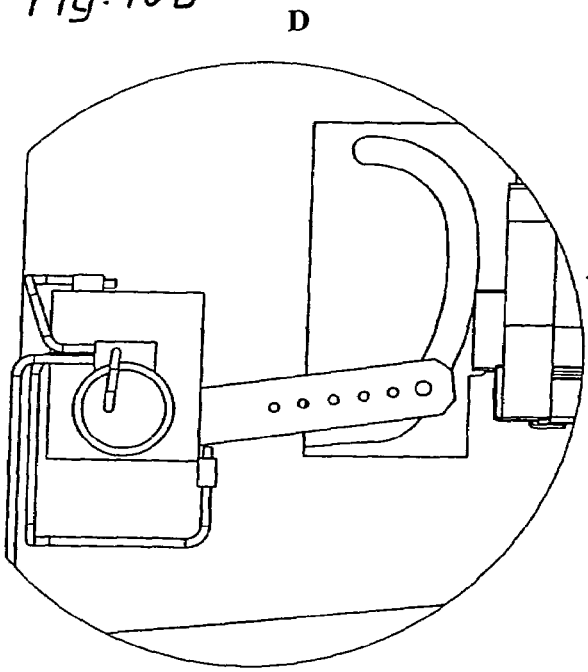
Figure 10A:
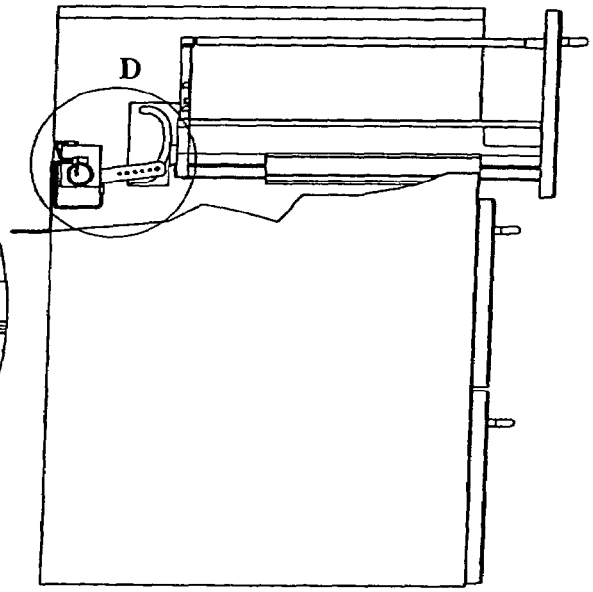

FIG. 1 is a perspective view of an embodiment of the ejection and insertion device according to the invention, independent of its arrangement in the piece of furniture 1. A schematically represented drive unit 3 that comprises an electric motor 17 and a regulation device 16 can be seen. The device for the mechanical transmission of force 4 is developed in this embodiment as a pin 7 arranged on a lever 6 driven by the drive unit 3, the lever 6 being in its first end-position in FIG. 1. In this embodiment, the guide track 8 is defined as a recess in the sliding block 10 by back and front boundary surfaces 11, 12. The shown guide track 8 has an open end that forms the position 9 for the exit and entry of the pin 7 and a closed end. The position of the pin 7 in its first end-position can be chosen by moving and fixing the sliding block 10 in the direction of movement of the movable furniture component 2. In the example shown, a position was chosen in which the pin 7 is in the horizontal area of the guide track 8. On the other hand, a sliding block 10 moved slightly to the right vis-à-vis that of FIG. 10 would have the advantage that in its end-position the pin 7 is already in the bevelled area of the guide track 8. This makes the initial manual removal easier as the pin 7 cannot jam in the guide track 8. Also particularly advantageous is that a completely manual removal and a subsequent manual closing movement are greatly facilitated as a result. This also means for example that the operability of the movable furniture component is not restricted in the event of a power failure. Also visible are the sensors 13, arranged in the end-positions of the lever 6, which are connected via lines 15 to the drive unit 3, more precisely, to the regulation device 16 of the electric motor 17.

Figure 2:
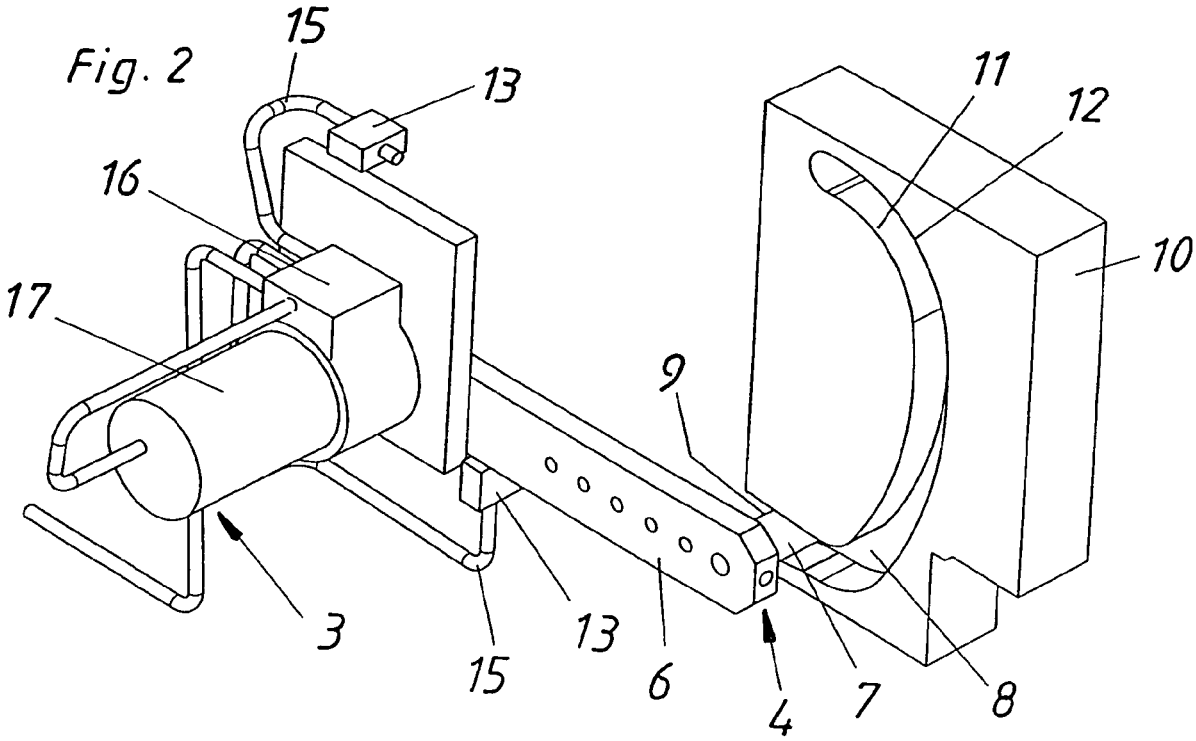
FIG. 2 is a second perspective view of an ejection or insertion device according to the invention.

The view shown in FIG. 2 differs from that shown in FIG. 1 in that the lever 6 is in the second end-position, in which the pin 7 is in position 9, developed as an opening, of the guide track 8 at which it can be removed from the guide track 8 or be inserted into it.

Figure 3A:
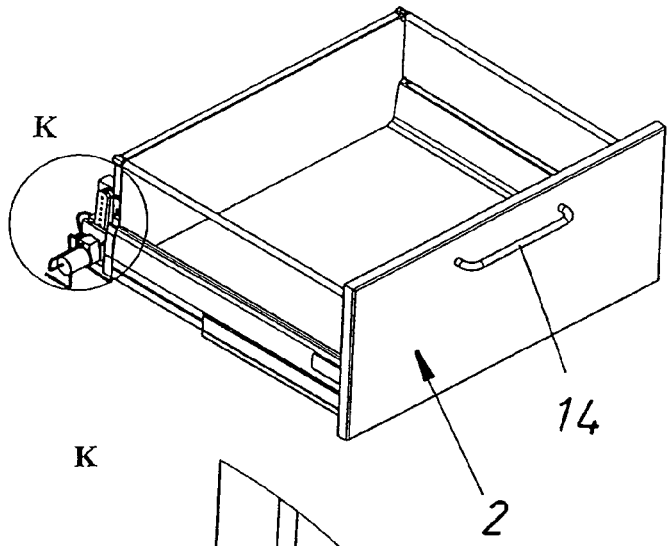
FIGS. 3*a*, 3*b* are each a first perspective view of a drawer according to the invention as well as a view of a detail K.
Figure 3B:
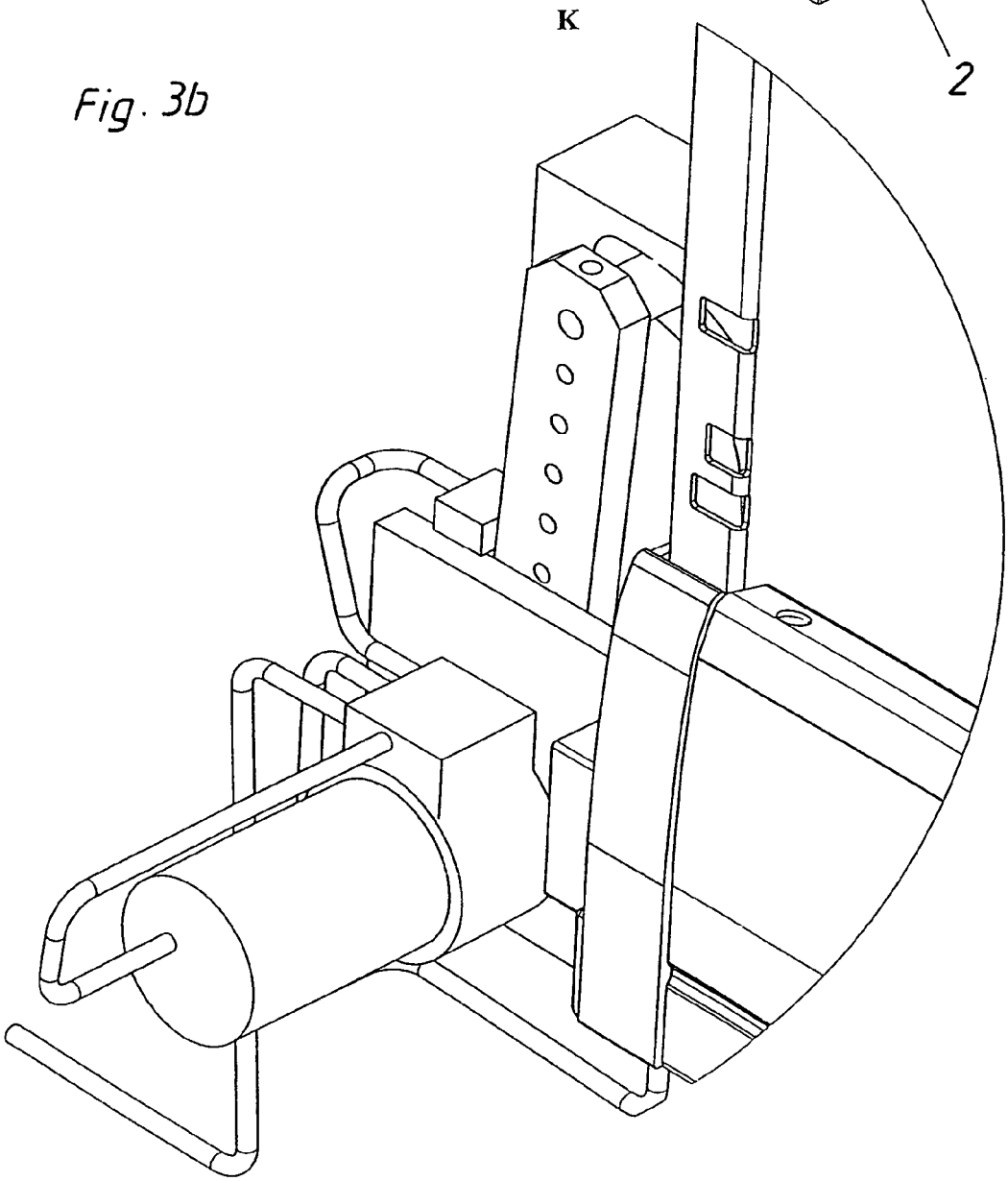

FIGS. 3*a* and 3*b* show the arrangement represented in FIG. 1 in its position relative to the movable furniture component 2, which is a drawer in this embodiment.

Figure 4A:
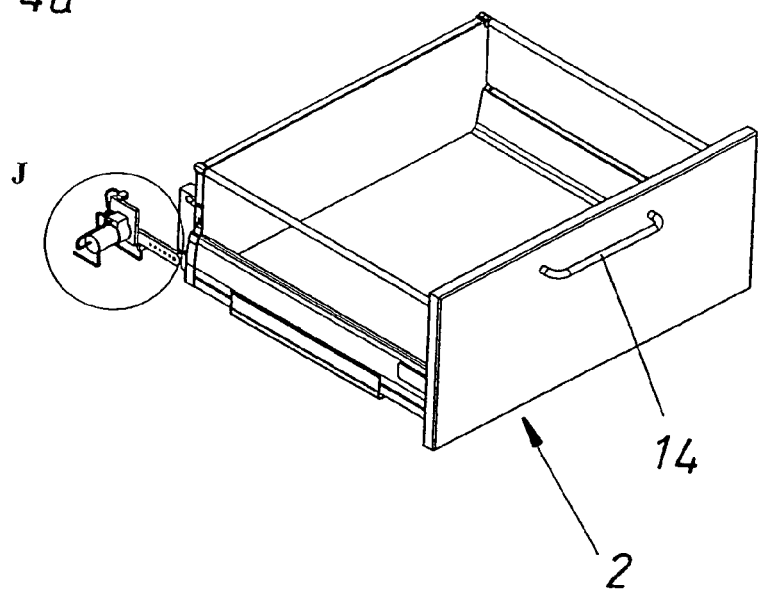
FIGS. 4*a*, 4*b* are each a second perspective view of a drawer according to the invention as well as a view of a detail J.
Figure 4B:
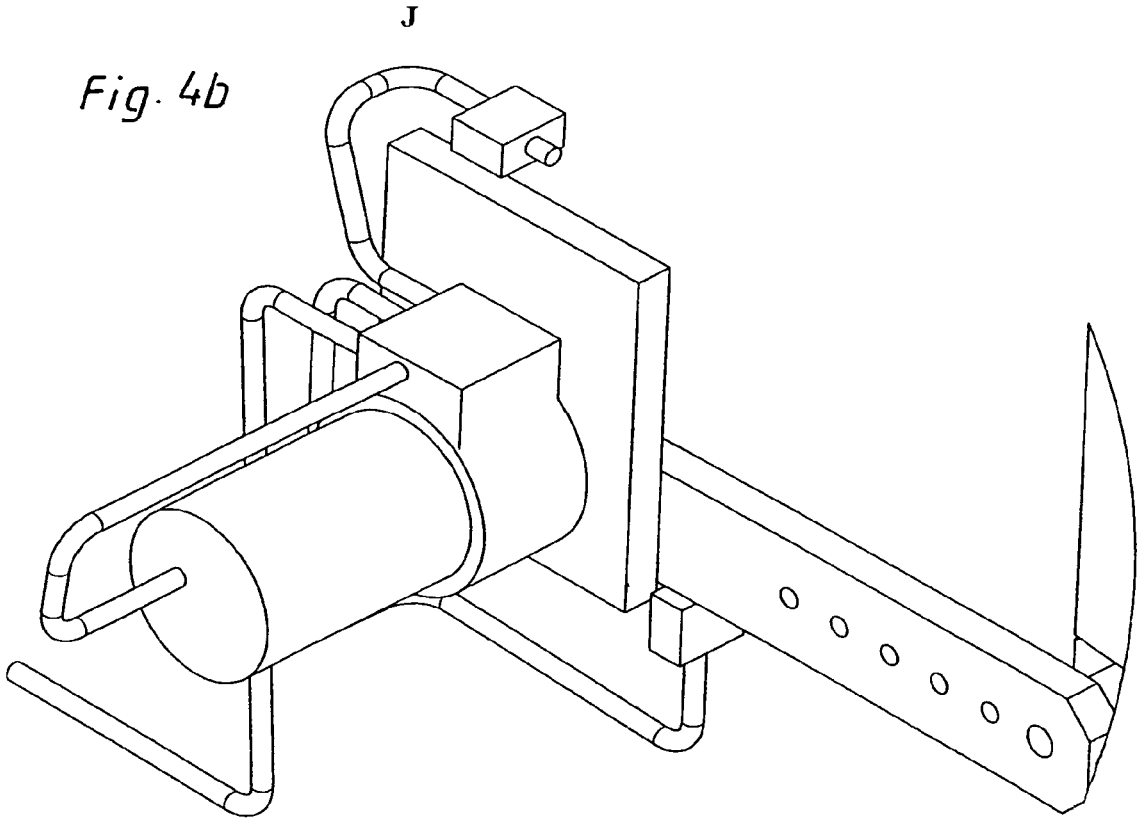

FIGS. 4*a* and 4*b* show the arrangement represented in FIG. 2 in its position relative to the movable furniture component 2.

Figure 5A:
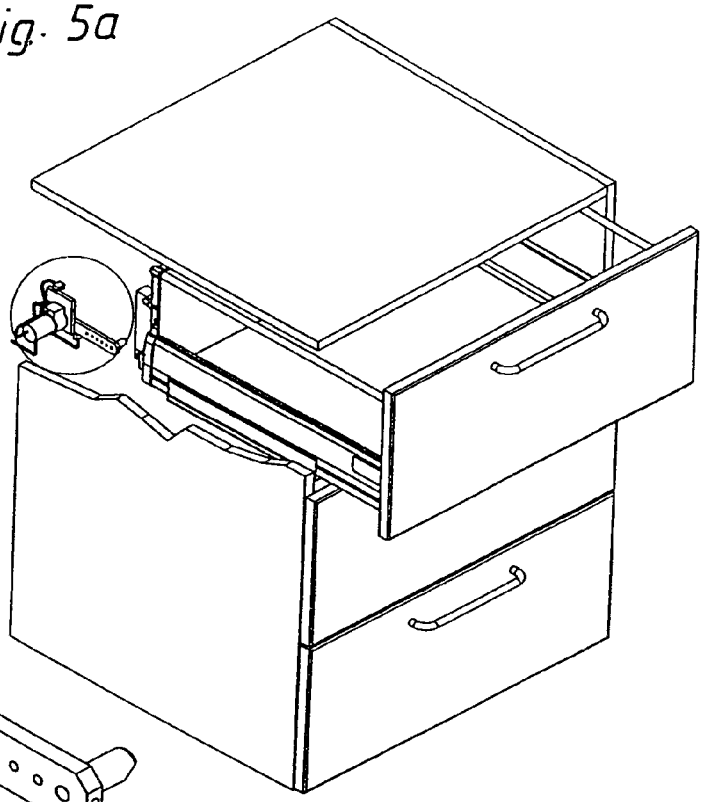
FIGS. 5*a*, 5*b* are each a first perspective view of a piece of furniture according to the invention as well as a view of a detail G.
Figure 5B:
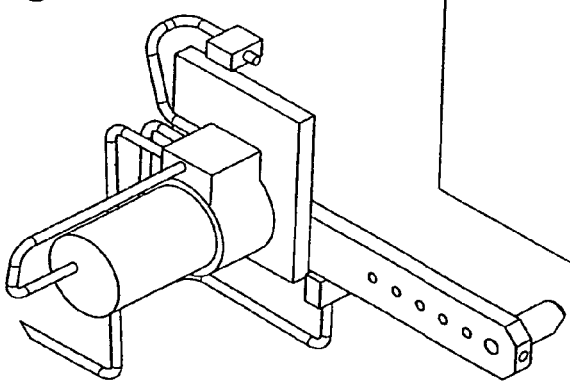

FIGS. 5*a* and 5*b* show the arrangement represented in FIG. 2 and the drawer represented in FIGS. 4*a* and 4*b* in its position in the piece of furniture 1.

Figure 6A:
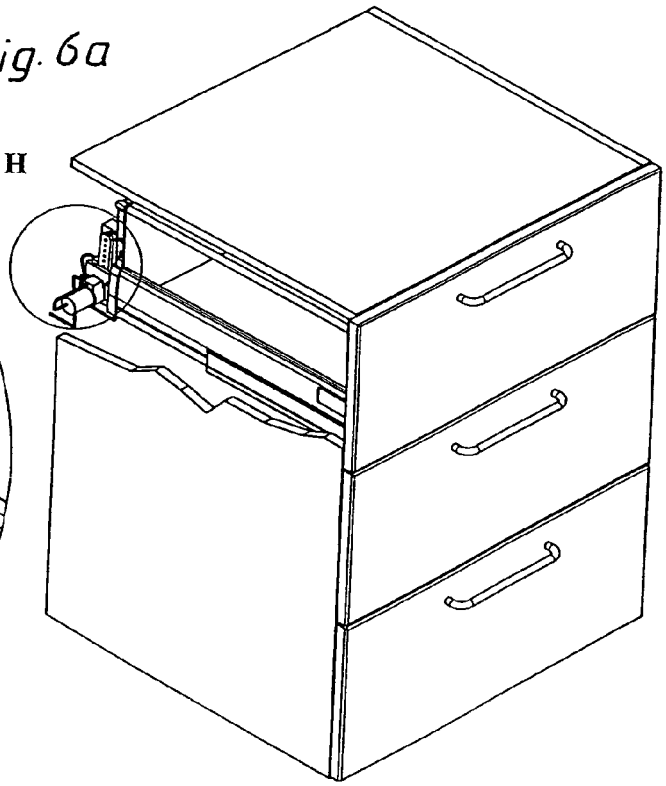
FIGS. 6*a*, 6*b* are each a second perspective view of a piece of furniture according to the invention as well as a view of a detail H.
Figure 6B:
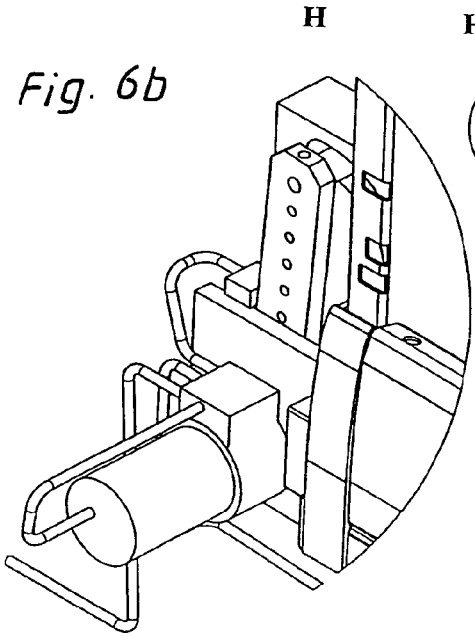

FIGS. 6*a* and 6*b* show the arrangement represented in FIG. 1 and the drawer represented in FIGS. 3*a* and 3*b* in its position in the piece of furniture 1.

An ejection process according to the invention may be explained with reference to FIGS. 7*a* and 7*b* to 12*a* and 12*b* using the embodiment represented there. Kinematic reversal results in the insertion process according to the invention.

Figure 7B:
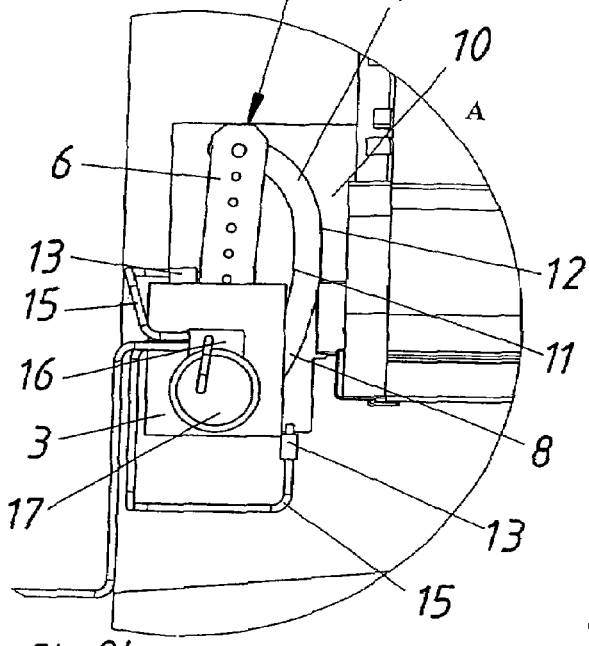
FIGS. 7*a*, 7*b*, to 12*a*, 12*b* are each a side-view of a piece of furniture according to the invention with partially removed side-wall as well as a view of a detail AF for various stages of an opening and closing process according to the invention.
Figure 7A:
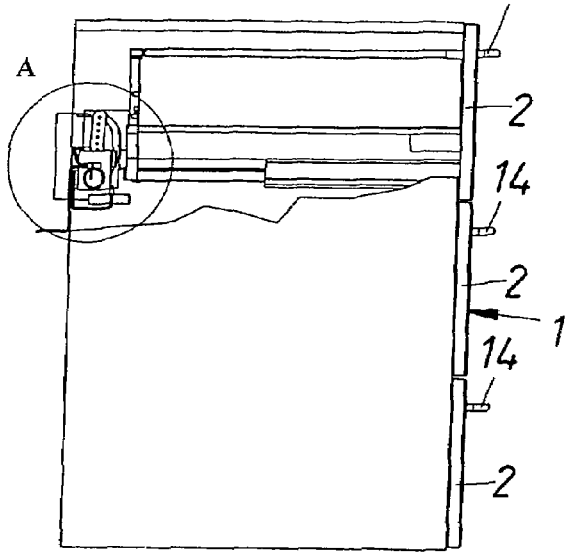

FIGS. 7*a* and 7*b* show a piece of furniture 1 with several movable furniture components 2 designed as drawers. The drawers each have a handle 14 on their front panel. At the level of the topmost drawer, the side wall has been partly removed to allow a view of the inside of the piece of furniture 1. Visible in the detail view designated A and represented in FIG. 7*b* are the drive unit 3 and also the lever 6 driven by it which are attached in the inside of the piece of furniture 1 to the back of the body of the furniture 5. The guide track 8 is developed as a recess in a sliding block 10 attached to the back of the drawer. The drawer is in its closed end-position. The pin 7, not visible in this figure, is at the free (distal) end of the lever 6. The lever 6 is shown in its first end-position and covers the upper sensor 13, which in this embodiment is developed, like the lower sensor 13, as an optical sensor.

Figure 8B:
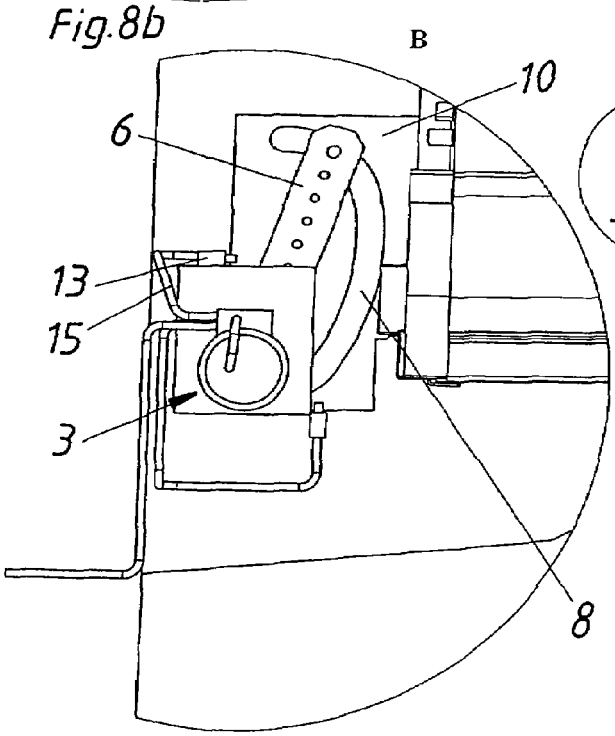
Figure 8A:
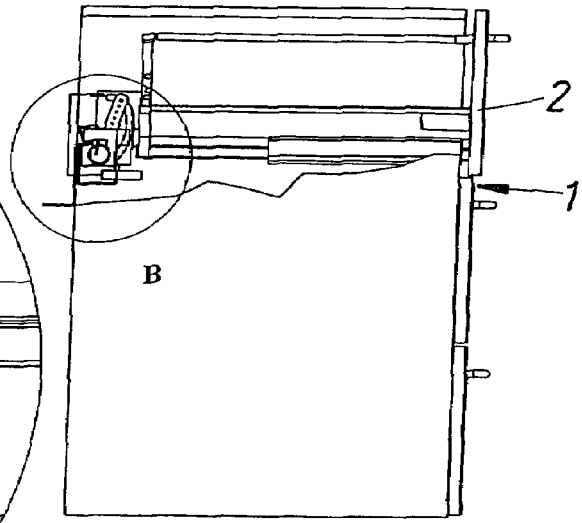
Figure 9B:
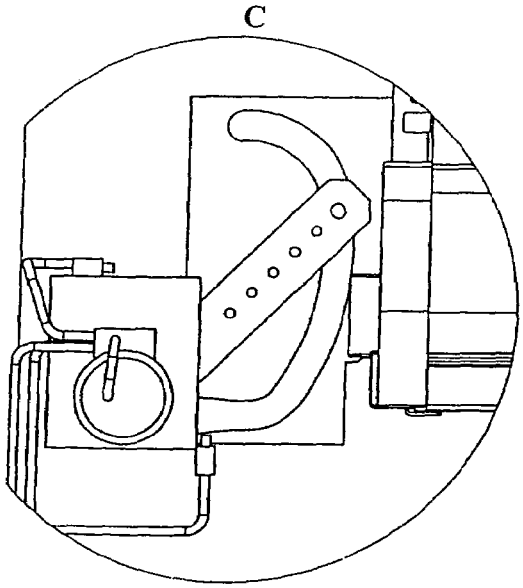
Figure 9A:
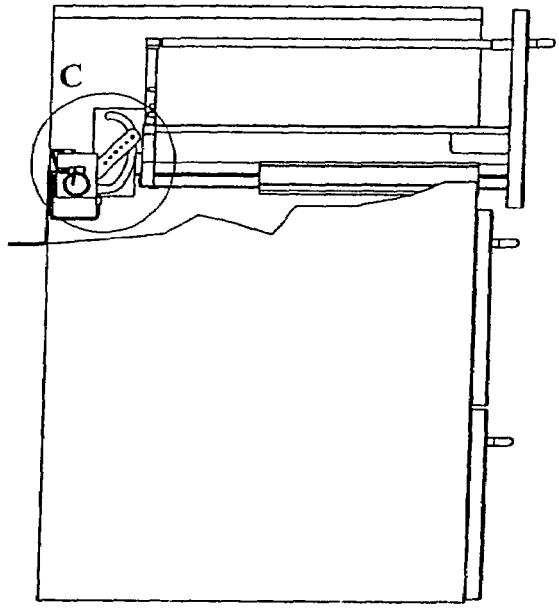

FIGS. 8*a* and 8*b* show the piece of furniture 1 after a slight manual movement, caused by a user, not shown, of the drawer out of its closed end-position. The sliding block 10 secured to the drawer is thereby also moved in this direction as a result of which the pin 7 arranged in the guide track 8 and thus the lever 6 are moved by the sliding block 10 out of the first end-position. As can be seen, the lever 6, also moved via the pin 7, has also been thereby moved away from the upper sensor 13, which has been registered by the latter and reported via the line 15 to the drive unit 3.

Figure 11B:
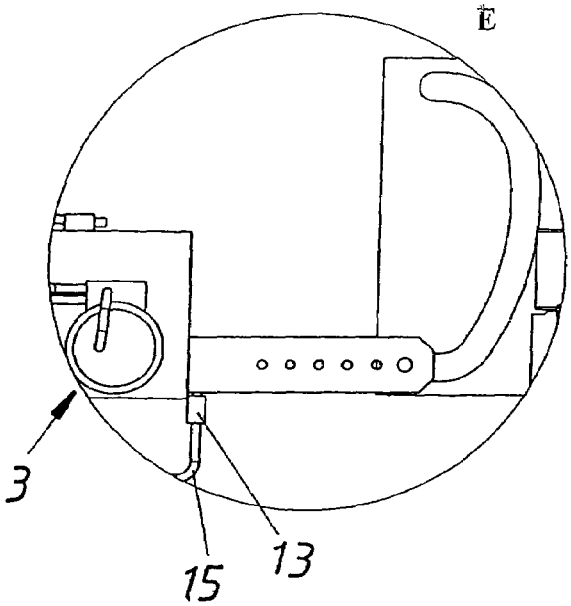
Figure 11A:
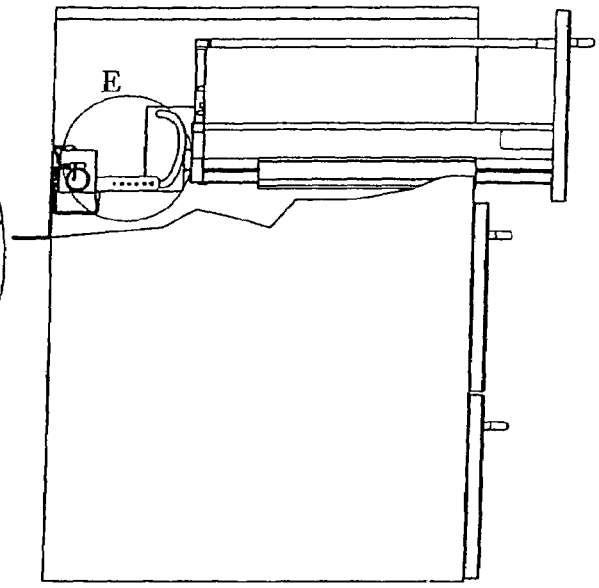

Through the resulting activation of the drive unit 3, the lever 6 is moved out of the first end-position represented in FIGS. 7*a* and 7*b*, and into the second end-position represented in FIGS. 11*a* and 11*b*. FIGS. 8*a* and 8*b* to 10*a* and 10*b* show the movement that has taken place meantime in chronologically sequential snapshots. To accelerate the drawer, pressure (thrust) is exerted by the pin 7 entrained together with the lever 6 on the front boundary surface 12 of the guide track 8 as a result of which the drawer is accelerated in the direction of its fully-opened end-position. An early decoupling of the drawer from the drive unit 3 is prevented by the rear boundary surface 11 of the guide track 8 which, if necessary (i.e., if the acceleration of the drawer is too great), brakes the pin 7 by exerting tension on it in the direction of the closed end-position of the drawer. As the clear width of the guide track 8 formed by the two boundary surfaces 11, 12 is approximately the same size as the diameter of the pin 7 or the diameter of a castor optionally arranged on the pin 7, a jerky movement of the drawer during the ejection process is prevented.

When the lever 6 reaches the almost horizontal position (second end-position) shown in FIGS. 11*a* and 11*b*, the lever 6 covers the lower sensor 13, which the latter reports via the line 15 to the drive unit 3. In reaction to this, the drive unit 3 deactivates itself. In the almost horizontal position of the lever 6, the pin 7 is located in this embodiment directly in front of the position (open end) 9 of the guide track 8 from which it can be removed from the guide track 8 (i.e., the recess arranged in the sliding block 10) upon a further movement, due to inertia, of the drawer.

Figure 12B:
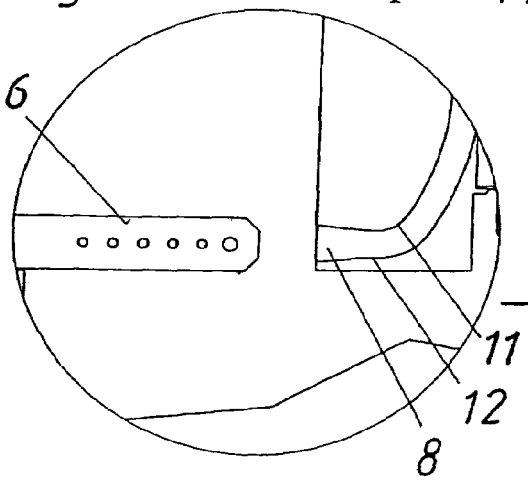
Figure 12A:
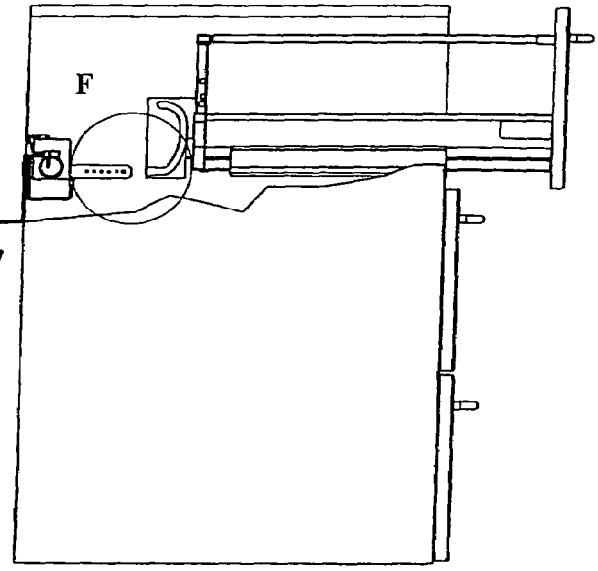

As is visible in FIGS. 12*a* and 12*b*, the drawer then moves on at a final speed dependent on its overall mass, only under the influence of friction forces in the direction of its fully-opened end-position. The lever 6 remains in its horizontal second end-position until the drawer is moved by a user into the position shown in FIGS. 11*a* and 11*b* relative to the body of the furniture 5. As a result, the pin 7 re-enters the guide track 8 and is accelerated by the forces exerted on it by the boundary surfaces 11, 12. As a result, the lever 6 connected to the pin 7 releases the lower sensor 13, which leads to the activation of the drive unit 3 and thus, through the insertion caused thereby of the drawer, into its closed end-position in the piece of furniture 1. The drawer reaches its fully-closed end-position at a negligible final speed or at zero speed, which avoids closure noises and protects both drawer and piece of furniture 1. A preset or presettable speed profile of the movable furniture component 2 can also be realized via the voltage induced in the drive unit 3.

Figure 13A:
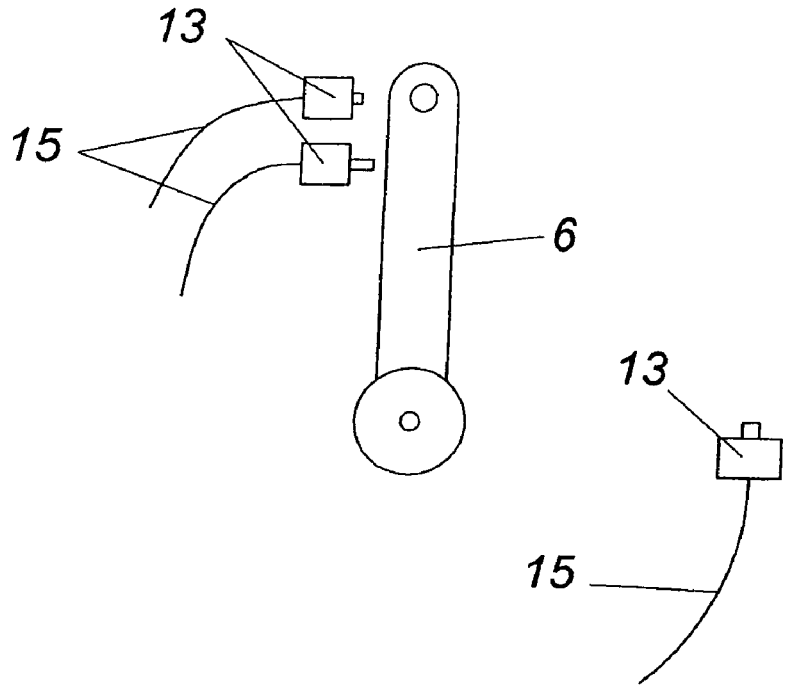
FIGS. 13*a*, 13*b* are each a schematic representation of another embodiment of the ejection or insertion device according to the invention.
Figure 13B:
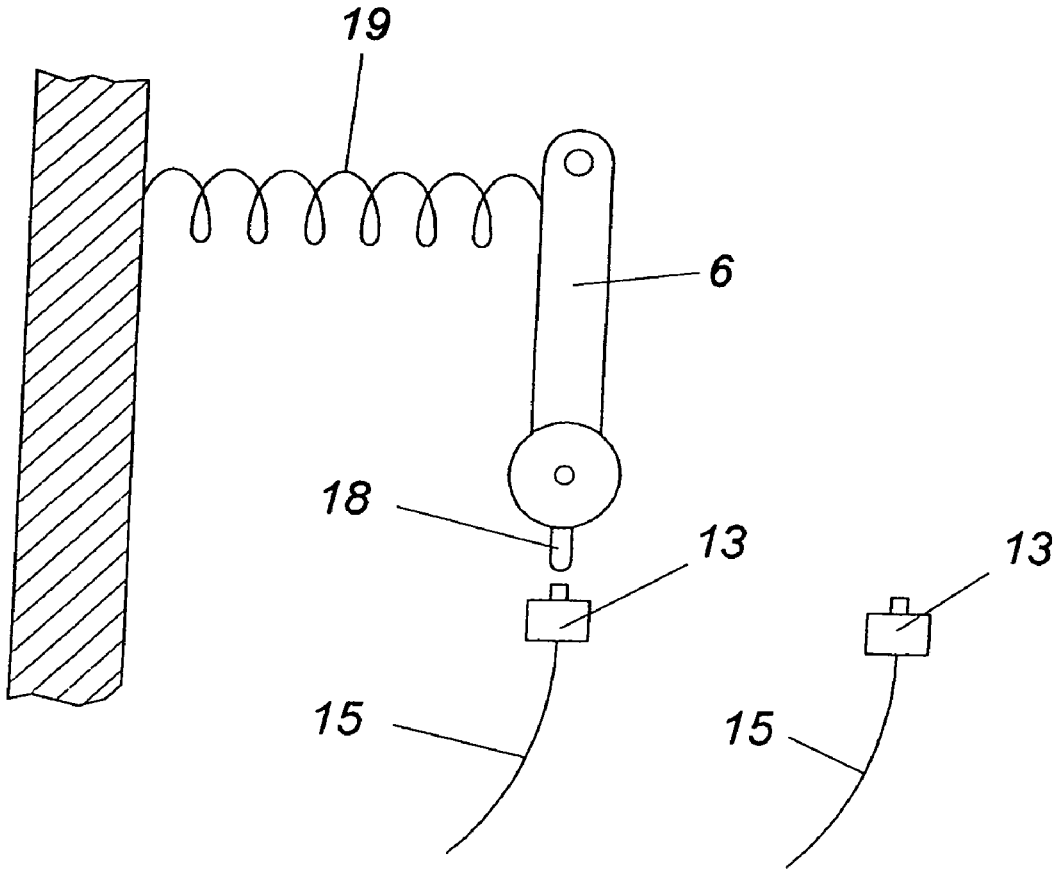

FIGS. 13*a* and 13*b* show schematically two further embodiments for the triggering of the device according to the invention by tensile or thrust triggering. A fresh representation and description of details that remain unchanged vis-à-vis the device shown in FIGS. 1 to 12 has been dispensed with.

FIG. 13*a* shows the arrangement of two sensors 13 in the vicinity of the lever 6 in its almost vertical position (first end-position). The two sensors 13 have different activation paths. When tension is exerted on the movable furniture component 2, the lever 6 is entrained clockwise by the sliding block 10, not shown, and thus releases the lower sensor 13. The latter then triggers the drive unit 3. When pressure is exerted on the movable furniture component 2, the lever 6 is entrained anti-clockwise by the sliding block 10, for example by a bevel in the guide track 8, and thus covers the upper sensor 13. The latter then triggers the drive unit 3.

FIG. 13*b* shows the arrangement of a single sensor 13 below the lever 6 which, in the almost vertical position of the lever 6, is covered by a cam 18. When tension is exerted on the movable furniture component 2 the lever 6 is entrained clockwise by the sliding block 10, not shown, and thus releases the sensor 13. The latter then triggers the drive unit 3. When pressure is exerted on the movable furniture component 2 the lever 6 is entrained anti-clockwise by the sliding block 10, for example by a bevel in the guide track 8, and thus releases the sensor 13. Too great a movement of the lever 6 out of the vertical position is prevented by a spring 19 acting on the lever 6. The sensor 13 triggers the drive unit 3, as a result of which the lever is moved clockwise and covers the sensor 13 anew. To prevent the triggering of yet another connection process, the renewed signal of the sensor 13 can for example be briefly ignored by a timer when the movable furniture component 2 is pulled out.

The invention claimed is:

1. An apparatus for moving a movable furniture component of a piece of furniture, said apparatus comprising:

a drive unit comprising an electric motor; and a device for mechanically transmitting force from said drive unit to the movable furniture component or a body of the piece of furniture so as to eject and/or insert the movable furniture component, said device being arranged in a guide track shaped and arranged to transmit tensile and thrust forces, said guide track having at least one position for allowing insertion or removal of said device from said guide track, said device comprising a pin having a castor arranged thereon.

2. The apparatus of claim 1, wherein said drive unit and said device are to be arranged on the body of the piece of furniture, and said guide track is to be arranged on the movable furniture component.

3. The apparatus of claim 1, further comprising a control unit for regulating an operation of said drive unit.

4. The apparatus of claim 3, further comprising at least one sensor for generating signals to be fed to said control unit.

5. The apparatus of claim 1, wherein said device is arranged and operable to be moved between two end positions.

6. The apparatus of claim 5, further comprising at least one sensor for detecting whether said device is located at one of the two end positions, said at least one sensor being operable to generate signals to be fed to said control unit.

7. The apparatus of claim 6, wherein each of said at least one sensor comprises an optical sensor.

8. The apparatus of claim 1, wherein said drive unit further comprises at least one of a current-measurement device, a voltage-measurement device, and a position-measurement device.

9. The apparatus of claim 8, wherein said drive unit further comprises said position-measurement device integrated in said electric motor.

10. The apparatus of claim 1, wherein said device is operable to move the movable furniture component between a closed end position and an open end position, said device being shaped and arranged to be inserted into said guide track or removed from said guide track between the closed end position and the open end position.

11. The apparatus of claim 1, wherein said guide track comprises a groove or recess.

12. The apparatus of claim 1, wherein said guide track is located in mounting component to be secured to the movable furniture component or to the body of the piece of furniture.

13. The apparatus of claim 1, wherein said device or said guide track is to be arranged on the movable furniture component.

14. An apparatus for moving a movable furniture component of a piece of furniture a predetermined distance said apparatus comprising:

a drive unit comprising an electric motor; and a device for mechanically transmitting force from said drive unit to the movable furniture component or a body of the piece of furniture so as to eject and/or insert the movable furniture component said device being arranged in a guide track shaped and arranged to transmit tensile and thrust forces, said guide track having at least one position for allowing insertion or removal of said device from said guide track;

wherein said device comprises a pin on a lever to be powered by said drive unit, a length of said lever being less than the predetermined distance.

15. The apparatus of claim 14, wherein the length of said lever is less than half of the predetermined distance.

16. The apparatus of claim 15, wherein the length of said lever is less than one-third of the predetermined distance.

17. An apparatus for moving a movable furniture component of a piece of furniture, said apparatus comprising:

a drive unit comprising an electric motor; and a device for mechanically transmitting force from said drive unit to the movable furniture component or a body of the piece of furniture so as to eject and/or insert the movable furniture component, said device being arranged in a guide track shaped and arranged to transmit tensile and thrust forces, said guide track having at least one position for allowing insertion or removal of said device from said guide track;

wherein said device comprises a pin on a lever to be powered by said drive unit.

18. An apparatus for moving a movable furniture component of a piece of furniture, said apparatus comprising:

a drive unit comprising an electric motor; and a device for mechanically transmitting force from said drive unit to the movable furniture component or a body of the piece of furniture so as to eject and/or insert the movable furniture component, said device being arranged in a guide track shaped and arranged to transmit tensile and thrust forces, said guide track having at least one position for allowing insertion or removal of said device from said guide track;

wherein said guide track is curved.

19. An apparatus for moving a movable furniture component of a piece of furniture along a direction of movement, said apparatus comprising:

a drive unit comprising an electric motor; and a device for mechanically transmitting force from said drive unit to the movable furniture component or a body of the piece of furniture so as to eject and/or insert the movable furniture component, said device being arranged in a guide track shaped and arranged to transmit tensile and thrust forces, said guide track having at least one position for allowing insertion or removal of said device from said guide track;

wherein a tangent to a portion of said guide track is parallel to the direction of movement.

20. An apparatus for moving a movable furniture component of a piece of furniture, said apparatus comprising:

a drive unit comprising an electric motor; and a device for mechanically transmitting force from said drive unit to the movable furniture component or a body of the piece of furniture so as to eject and/or insert the movable furniture component, said device being arranged in a guide track shaped and arranged to transmit tensile and thrust forces, said guide track having at least one position for allowing insertion or removal of said device from said guide track;

wherein said guide track is a level curve.

21. An apparatus for moving a movable furniture component of a piece of furniture, said apparatus comprising:

a drive unit comprising an electric motor; and a device for mechanically transmitting force from said drive unit to the movable furniture component or a body of the piece of furniture so as to eject and/or insert the movable furniture component, said device being arranged in a guide track shaped and arranged to transmit tensile and thrust forces, said guide track having at least one position for allowing insertion or removal of said device from said guide track;

wherein said guide track has two ends, at least a first one of said two ends of said guide track being open; and wherein a second one of said two ends of said guide track is closed, said guide track extending diagonally to a direction of movement of the movable furniture component at said closed second one of said two ends.

* * * * *